US005215600A

United States Patent [19]

Bertolini et al.

[11] Patent Number: 5,215,600

[45] Date of Patent: Jun. 1, 1993

[54] THERMOMECHANICAL TREATMENT OF TI 6-2-2-2-2

[75] Inventors: Mark S. Bertolini, Chula Vista; Brian Norris, San Diego; Michael J. Waring, Chula Vista, all of Calif.

[73] Assignee: Rohr, Inc., Chula Vista, Calif.

[21] Appl. No.: 733,894

[22] Filed: Jul. 22, 1991

[51] Int. Cl.[5] ..... C22F 1/00; C21D 8/00

[52] U.S. Cl. ..... 148/564; 72/709; 148/670; 420/419; 420/421; 420/902

[58] Field of Search ..... 148/11.5 F, 127 B, 133; 72/709; 420/419, 421, 902

[56] References Cited

U.S. PATENT DOCUMENTS

| | | | |
|---|---|---|---|
| 4,181,000 | 1/1980 | Hamilton et al. | 72/709 |
| 4,233,831 | 11/1980 | Hamilton et al. | 72/709 |
| 4,375,375 | 3/1983 | Giamel et al. | 148/11.5 F |
| 4,415,375 | 11/1983 | Lederich et al. | 148/11.5 F |
| 4,867,807 | 9/1989 | Torisaka et al. | 148/11.5 F |
| 4,944,914 | 7/1990 | Ogawa et al. | 148/12.7 B |
| 5,039,356 | 8/1991 | Weiss et al. | 148/11.5 F |

OTHER PUBLICATIONS

Weiss et al. Met. Trans. 17A (1986) 1935.
Ghosh et al. Met. Trans. 13A (1982) 733.
Wert et al. Met. Trans. 14A (1983) 2535.

*Primary Examiner*—Upendra Roy
*Attorney, Agent, or Firm*—Patrick J. Schlesinger; Frank D. Gilliam

[57] ABSTRACT

A sheet of Ti 6-2-2-2-2 alloy having a starting thickness of between approximately 0.040 inches and 0.187 inches is thermomechanically treated at a temperature of between approximately 1500 degrees F. and 1750 degrees F. at a mechanical strain rate in the range of between approximately $1\times10^{-4}$ and $1\times10^{-2}$ inch per inch per second to produce a formed part having a tensile strength which is approximately 33% greater than untreated rolled Ti 6-2-2-2-2 alloy sheet or plate.

10 Claims, 1 Drawing Sheet

THERMOMECHANICAL TREATMENT OF TI 6-2-2-2-2

BACKGROUND OF THE INVENTION

The present invention relates to Titanium alloys, and more particularly, to a process of treating Ti 6-2-2-2-2 alloy to significantly enhance the tensile strength thereof, and to a part so formed.

For many years it has been known that certain metals, such as Titanium, as well as certain metal alloys, exhibit superplasticity within limited temperature ranges and strain rates. Superplasticity is the capability of a material to develop unusually high tensile elongations with a reduced tendency towards necking. Thus when in a superplastic condition, the metal or metal alloy exhibits low resistance to deformation and may be elongated with controlled thinning. This permits a sheet of such metal to be readily formed against dies to achieve desired shapes. Further details of SPF may be had by way of reference to U.S. Pat. No. 3,934,441 of Hamilton et al. entitled "Controlled Environment Superplastic Forming of Metals" and U.S. Pat. No. 3,927,817 of Hamilton et al. entitled "Method of Making Metallic Sandwich Structures."

In the early 1960's the U.S. Air Force funded the development of deep hardenable forging grade alloys. One alloy that was developed is Ti 6Al-2Sn-2Zr-2Cr-2Mo-0.25Si, herein referred to as "Ti 6-2-2-2-2". This alloy has heretofore only been forged and machined into aircraft parts.

Ti 6-4 is currently the Titanium alloy of choice for aerospace applications in the 400°-700° F. temperature range, e.g. adjacent to turbofan engines. It would be desirable to provide an alternative to Ti 6-4 alloy which would provide a higher strength-to-weight ratio.

SUMMARY OF THE INVENTION

It is therefore the primary object of the present invention to provide a Titanium alloy with enhanced tensile strength.

It is another object of the present invention to provide a process of treating Ti 6-2-2-2-2 to increase its tensile strength.

It is another object of the present invention to provide a method of forming a Ti 6-2-2-2-2 part in order to give it increased tensile strength.

It is yet another object of the present invention to provide a Ti 6-2-2-2-2 part having increased tensile strength.

According to the illustrated embodiment of our invention a sheet of Ti 6-2-2-2-2 alloy having a starting thickness of between approximately 0.040 inches and 0.187 inches is superplastically formed at a temperature of between approximately 1500 degrees F. and 1750 degrees F. at a mechanical strain rate in the range of between approximately $1\times10^{-4}$ and $1\times10^{-2}$ inch per inch per second to produce a formed part having a tensile strength which is approximately 33% greater than untreated Ti 6-2-2-2-2 alloy sheet or plate.

DESCRIPTION OF THE PREFERRED EMBODIMENTS

We have discovered that the tensile strength of Ti 6-2-2-2-2 can be significantly increased by thermomechanically treating the same. According to our invention, a work piece of the alloy is heated and then subjected to thermomechanical deformation. Tests have shown that room temperature tensile strength can be increased from approximately 165 KSI to 220 KSI. Further tests have shown that strength and ductility properties can be further enhanced by subsequent heat treatments such as aging.

Figure 1:
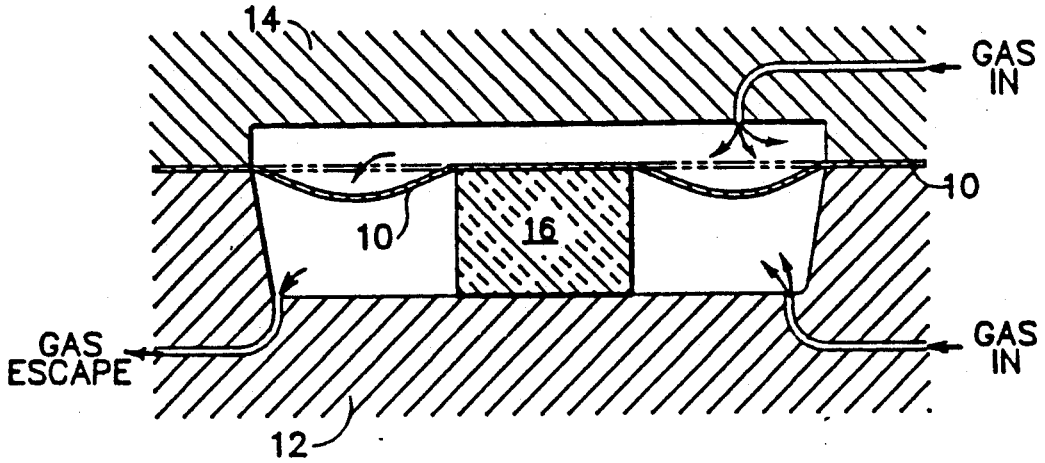
FIG. 1 is simplified vertical sectional view illustrating the initial phase of an SPF technique which is a preferred method of thermomechanical treatment of a Ti 6-2-2-2-2 work piece according to our invention.
Figure 2:
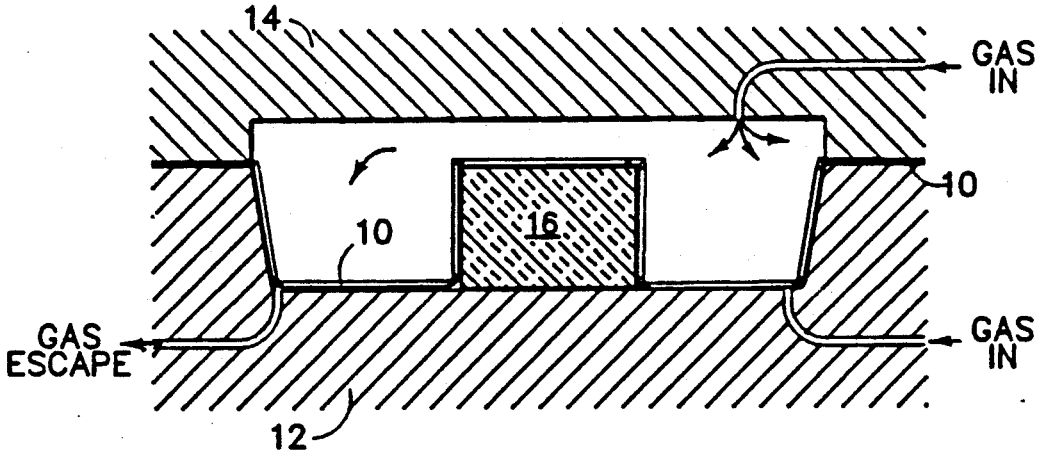
FIG. 2 is a view similar to FIG. 1 illustrating the formed work piece.

Referring to FIG. 1, a relatively large sheet 10 of Ti 6-2-2-2-2 is laid horizontally across an upwardly opening steel forming chamber 12. The sheet 10 forms a part blank. Preferably the starting thickness of the part blank 10 is between approximately 0.040 inches and 0.187 inches. The chamber is supported in a press (not shown) so that a steel cover 14 can be closed against the chamber 12 from above. The peripheral edges of the part blank are firmly clamped between the mating edges of the forming chamber 12 and the cover 14. In order to provide an air-tight seal, the cover 14 preferably has a peripheral seal (not illustrated). The part blank 10 is heated, utilizing electric coils (not illustrated) associated with the cover 14. Preferably the part-blank is heated to a temperature of between about 1500 degrees F. and 1750 degrees F. At this temperature, the part blank exhibits superplasticity and may be formed around a ceramic or metal die 16 supported on a bottom wall of the forming chamber, as illustrated in FIG. 2. This formation results from the introduction of argon gas at different pressures on either side of the sheet. Preferably, the Titanium alloy part blank is subjected to a strain rate in the range of between approximately $1\times10^{-4}$ and $1\times10^{-2}$ inch per inch per second. The part blank is preferably stretched between approximately 50% and 1000%.

Once the Titanium alloy part blank 10 has been formed into the desired part the Argon gas is released through a controlled pressure drop to atmospheric pressure. The press is actuated to separate the forming chamber 12 and the cover 14. An operator removes the part blank from around the die 16. Alternatively, an automatic part blank ejector may be used. The formed Titanium alloy part blank is allowed to cool in ambient air. The formed part may then be subjected to an aging heat treatment to further modify its strength and ductility. Thereafter, it is machined to cut away the excess portions of the part blank. Any routing, drilling or other finish machining that is required is performed at this time.

Our method of thermomechanical treatment of Ti 6-2-2-2-2 alloy can be used to increase the tensile strength of the alloy by as much as 33%. The mechanisms for this strength increase are not fully understood at this time. We suspect that both the shape and volume fractions of each of the phases within the alloy are changed during the thermomechanical treatment.

While we have described a preferred embodiment of our method of thermomechanical treatment of Ti 6-2-2-2-2 alloy, and we have described a Ti 6-2-2-2-2 alloy part having increased tensile strength, it should be understood by those skilled in the art that our invention may be modified in both arrangement and detail. For example, the thermomechanical treatment need not be performed by SPF but could be done by rolling, hammering, extruding, or drawing after the alloy has been elevated to a temperature of between approximately 1500 F. and 1750 degrees F. Furnaces, heated dies, heated platens or other heating implements could be utilized. Ti 6-2-2-2-2 plate with a thickness of 0.250 inches or greater may be so treated. Therefore, the protection afforded our invention should only be limited in accordance with the scope of the following claims.

We claim:

1. A method of treating Ti 6-2-2-2-2 alloy to enhance the tensile strength thereof, comprising the steps of:

heating a work piece of the alloy to a temperature in the range of between approximately 1500 degrees F. and 1750 degrees F.; and subjecting the heated work piece to mechanical strain in the range of between approximately $1\times10^{-4}$ and $1\times10^{-2}$ inch per inch per second.

2. A method according to claim 1 wherein the Ti 6-2-2-2-2 alloy work piece comprises a sheet having a thickness of between approximately 0.040 inches and 0.187 inches.

3. A method according to claim 2 wherein the Ti 6-2-2-2-2 sheet is subjected to mechanical strain by superplastic forming.

4. A method according to claim 3 wherein the Ti 6-2-2-2-2 sheet is stretched between approximately 50% and 1000% during superplastic forming.

5. An enhanced tensile strength Ti 6-2-2-2-2 alloy formed by the process of heating the alloy to a temperature between approximately 1500 degrees F. and 1750 degrees F. and subjecting the heated Ti 6-2-2-2-2 alloy to mechanical strain at a rate in the range of between approximately $1\times10^{-4}$ and $1\times10^{-2}$ inch per inch per second.

6. An enhanced tensile strength Ti 6-2-2-2-2 alloy according to claim 5 wherein the mechanical strain is applied by forming Ti 6-2-2-2-2 alloy into a sheet and forming the sheet by SPF.

7. An enhanced tensile strength Ti 6-2-2-2-2 alloy according to claim 6 wherein the Ti 6-2-2-2-2 alloy sheet has a starting thickness of between approximately 0.040 inches and 0.187 inches.

8. An enhanced tensile strength Ti 6-2-2-2-2 alloy according to claim 7 wherein the Ti 6-2-2-2-2 alloy sheet is stretched between approximately 50% and 1000% during SPF.

9. A method of enhancing the tensile strength of Ti 6-2-2-2-2 alloy, comprising the steps of;

providing a quantity of the Ti 6-2-2-2-2 alloy in the form of a sheet having a thickness of between approximately 0.040 inches and 0.187 inches;

placing a die on a bottom wall of an upwardly opening forming chamber having side walls with upper edges;

positioning the part blank over the die;

providing a cover for closing the chamber, the cover having a peripheral seal extending around a periphery thereof;

heating the part blank to a temperature of between approximately 1500 degrees F. and 1750 degrees F. at which it exhibits superplasticity;

introducing a pressurized gas into an interior formed between the part blank and the closed cover to press the part blank and form it around the die during which the part blank is subjected to mechanical strain in the range of between approximately $1\times10^{-4}$ and $1\times10^{-2}$ inch per inch per second;

releasing the pressurized gas from between the closed cover and the part blank;

lifting the cover and removing the formed part blank from the die;

allowing the formed part blank to cool to ambient temperature;

subjecting the formed part to a heat treatment to further modify its strength and ductility; and machining the formed part blank to remove any excess portions thereof.

10. A Titanium alloy part having increased tensile strength comprising a sheet of Ti 6-2-2-2-2 alloy having a thickness of between approximately 0.040 inches and 0.187 inches which has been heated to a temperature of between approximately 1500 degrees F. and 1750 degrees F. and superplastically formed around a die during which the part blank has been subjected to mechanical strain in the range of between approximately $1\times10^{-4}$ and $1\times10^{-2}$ inch per inch per second.

* * * * *